United States Patent [19]

Marsh

[11] 4,133,535

[45] Jan. 9, 1979

[54] PUTTING STROKE TRAINING DEVICE

[76] Inventor: Robert Marsh, "Romar", Crossmolina, County Mayo, Ireland

[21] Appl. No.: 746,032

[22] Filed: Nov. 30, 1976

[30] Foreign Application Priority Data

Dec. 1, 1975 [IE] Ireland ..... 2604/75

[51] Int. Cl.[2] ..... A63B 69/36

[52] U.S. Cl. ..... 273/192; 273/35 R; 273/32 H; 273/194 R

[58] Field of Search ..... 273/192, 195 R, 35 R, 273/186 A, 191 R, 191 A, 191 B, 186 R, 186 C, 32 H, 194 R, 191

[56] References Cited

U.S. PATENT DOCUMENTS

| | | | |
|---|---|---|---|
| 2,340,793 | 2/1944 | Chapman | 273/192 |
| 3,132,865 | 5/1964 | Parker | 273/192 |
| 3,215,436 | 11/1965 | Carter | 273/195 R X |
| 3,473,810 | 10/1969 | Nishikawa | 273/192 |
| 3,806,133 | 4/1974 | Cork | 273/192 |

FOREIGN PATENT DOCUMENTS

| | | | |
|---|---|---|---|
| 175197 | 2/1922 | United Kingdom | 273/192 |

*Primary Examiner*—George J. Marlo

*Attorney, Agent, or Firm*—Sughrue, Rothwell, Mion, Zinn and Macpeak

[57] ABSTRACT

A golf putting stroke training device is provided comprising a carriage slideable along a rectilinear guide member supported above ground in a horizontal position, a putter being rigidly attachable to the carriage. Optional locking pivot means are provided for varying and fixing the angle made by the putter shaft with the ground. A locating apparatus is also provided which by repeated placement of an inclined guide and by rolling a ball down the same, permits the training device to be properly positioned with respect to the hole by abutment with a spacer member of the said apparatus.

7 Claims, 7 Drawing Figures

1
2
3
4
5
6
7
8
9
10
11
12
13
14
15
16
17
18
19
20
20a
26

PUTTING STROKE TRAINING DEVICE

This invention relates to the game of golf, and in particular to a device for training a player's putting stroke by confining the movement of the putter to a predetermined locus wherein continuous mechanical control is maintained over the direction of stroke and the orientation of the putter in space.

In the development of a good putting stroke, it is desirable that elbow and wrist movement be reduced to a minimum, and that as far as possible the entire stroke be generated by movement of the shoulder joints. Additionally, it is desirable that curved forward and back swing should be eliminated, as should any tendency to rotation of the putter shaft about its own long axis. The difficulty of concentrating on all these desiderata, while at the same time imparting sufficient kinetic energy to the ball to sink it, is well known to golfers.

It is an object of this invention to provide a putting stroke training device which will enable the golfer to concentrate on achieving a putting stroke of the desired impact magnitude, without simultaneous attention to the other factors mentioned above. It is another object of the invention to provide a device which by constraining the player's hands into a predetermined correct pathway, imprints a desired habit of movement on the player's memory and motor nervous system at a subconscious level, which habit persists in subsequent practice and play without the training device.

The invention therefore provides a putting stroke training device which comprises a ground-engaging support member;

a rectilinear guide member supportable in a horizontal attitude by the support member;

a carriage adapted to be positioned on the guide member and to be moved freely to and fro along the same but without freedom for lateral motion; and means for rigidly attaching a golf putter to the carriage in a standard putting position and orientation.

Preferred embodiments additionally provide that (a) the ground-engaging support member comprises at least two legs, adapted for parallel spaced-apart ground placement;

(b) the rectilinear guide member and the carriage are constructed with mutually engageable extensions or parts adapted to prevent pivoting movement of the carriage about the long axis of said guide member;

(c) a lockable pivotal joint is provided within the guide member/carriage/attachment means assembly whereby an attached golf putter can be pivoted about the long axis of the rectilinear guide member into a desired angle with the horizontal, and can be fixed at said angle for subsequent to and fro movement along the guide member.

The invention will be appreciated in greater detail from the following description of particular and preferred embodiments thereof, given by way of example only, with reference to the accompanying drawings, in which FIG. 1 is an exploded perspective view of a putting stroke training device and putter, including two-part putter attachment means, a carriage, a two-part rectilinear guide member and two ground-engaging support members;

Figure 6:
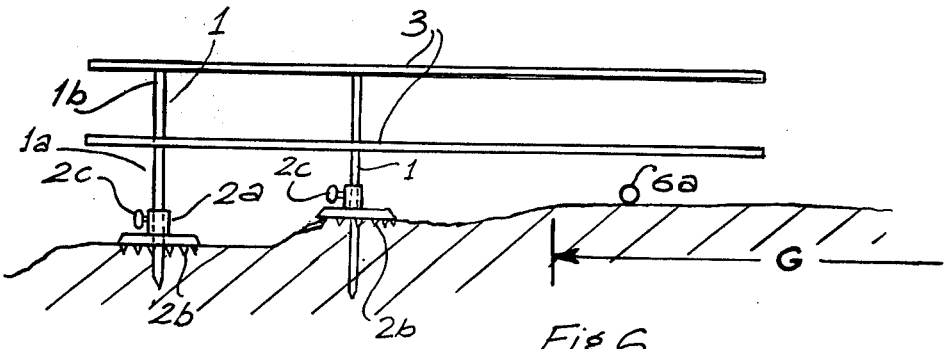
Figure 7:
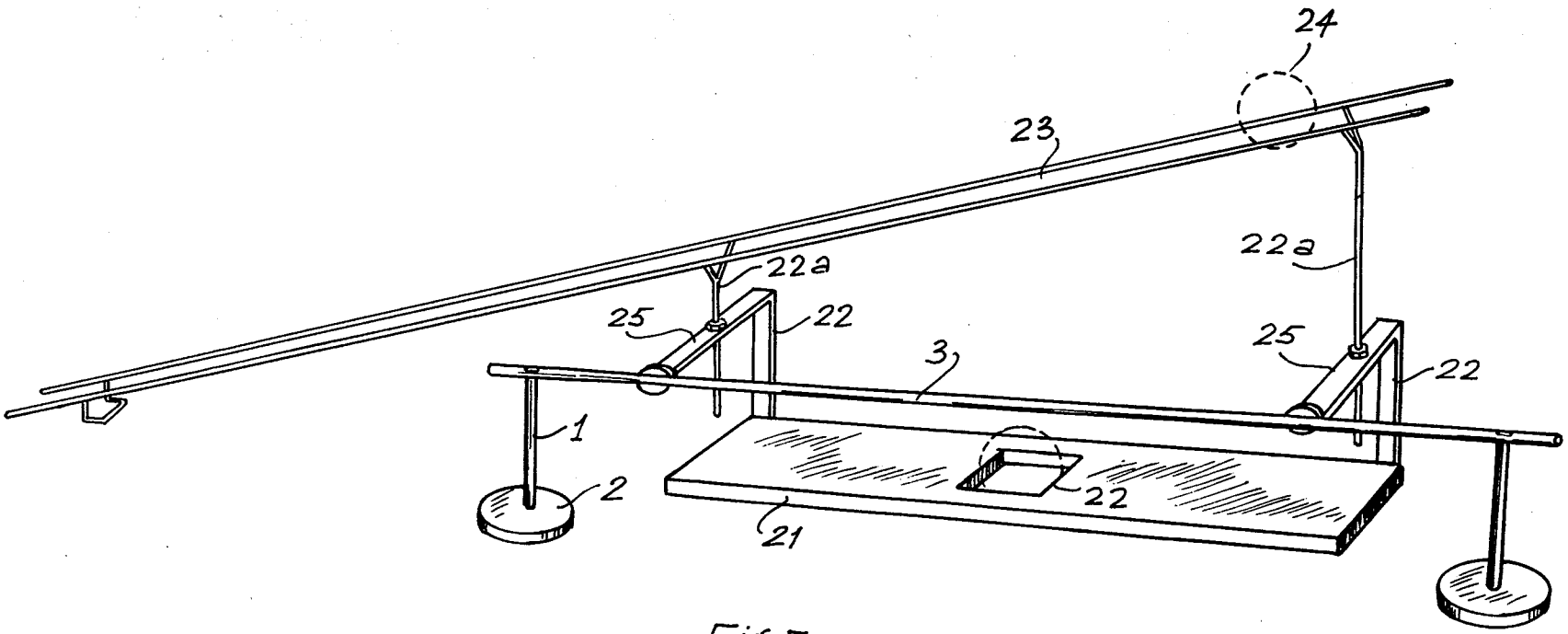

FIG. 6 is a front elevation of an assembled two-part rectilinear guide member and two support members, showing an alternative embodiment of the feet of the latter; and FIG. 7 is a perspective view of a locating apparatus for use in conjunction with the training devices of FIGS. 1–6, showing a rectilinear guide member and two support members of the training device in operative association therewith.

Referring now to the drawings, a putting stroke training device comprises a pair of ground- or floor-engaging legs 1 standing upon feet 2 and supporting a pair of rods 3 in a horizontal attitude by means of clamping bosses 4.

A carriage 5 comprises two opposed parallel walls 6 united by a bridge piece 7 which rests, in use, upon the upper one of the rods 3 and slides to and fro along said rods.

The carriage 5 is provided with a pair of upstanding discs 8 having parallel interior opposed faces 9 which bear raised radial ribs 10. Each disc 9 carries a centrally mounted wing-handled locking screw 11 which is freely rotatable in a hole in said disc. The tip of each screw 11 projects through the interior face of the disc 9 and said tip alone is screw-threaded. Conventional means are provided to prevent the screws 11 from becoming detached from the discs 9.

Means for rigidly attaching a golf putter 26 to the carriage 5 comprise a cooperating putter clamp 12 and pivot member 13 which can be quickly assembled and dismantled according as it is desired to use the training device or to practise putting without constraint. The putter clamp 12 bears a profiled extension 14 which slides into a corresponding undercut slot 15 in the pivot member 13. The profiled extension 14 and the slot 15 are slightly tapered to allow one to grip the other firmly. The putter clamp 12 comprises a hollow cylindrical receptacle 16 having lips 17 for insertion of the shaft of a putter thereinto. The lips can then be closed and the receptacle 16 tightened around the putter shaft by means of a lock screw 18. The receptacle 16 and lips 17 are of resilient material, and the receptacle 16 of slightly oval cross-section, so as to accommodate a range of putters having different shaft diameters at the point of attachment.

The pivot member 13 bears rigidly attached to the rear face thereof a drum 19 having ends 20 the diameter and separation of which permit the durm to be fitted exactly between the disc faces 9 on the carriage 5. In the center of each end face 20 is a screw threaded hole **20*a* adapted to receive the correspondingly threaded tip of a lock screw 11 upon assembly. Each face 20 bears a set of radial grooves adapted to engage with and receive the radial ribs of a disc face 9 before the lock screws 11 are tightened. Thus a range of pivotal positions of the pivot member 13 is available any one of which may be selected by rotating the pivot member 13 or the attached putter 26, and then fixed by tightening the lock screws 11, and each such position corresponds to a given angle of inclination of the shaft of the putter to the horizontal. Stepless pivotal adjustment can be provided by omitting the ribs 10 and grooves, and substituting cooperating faces 9, 20** having a high mutual coefficient of friction.

In use, a putter is inserted in the cavity 16 which is then clamped by means of the lock screw 18. The profile 14 is inserted into the slot 15, and the cylinder 19 inserted between the discs 8, the lock screws 11 being loosely entered into the threaded holes 20*a* in the cylinder faces 20. A suitable angle of inclination of the putter shaft to the horizontal is chosen and the shaft adjusted to this angle, whereupon the lock screws 11 are tightened. The lock screw 18 may then have to be loosened and the putter shaft slid up or down in the receptacle 16 until the head of the putter is at the correct playing height.

The feet 2 shown in the embodiments of FIGS. 1, 4, 5 and 7 comprise flat discs, and are suitable for putting practice on a floor or paved surface. Alternative feet 2*a* are shown in FIG. 6. These, it will be seen, are equipped with spikes or studs 2*b* for placement on a turf green, and the support members 1 are slidably mounted in central bores in bosses attached to said feet 2*a*, in which the support members 1 can be locked by means of set screws 2*c*. The lower end of each support member 1 is pointed, and the support member may be driven into the turf to a desired distance (before locking the set screws 2*c*) to increase the stability of the training device. The support members 1 may be equipped with small plumbing devices such as spirit levels to enable them to be vertically placed with accuracy, and the rods 3 may likewise be equipped with spirit levels to ensure accurately horizontal and parallel alignment thereof.

A useful additional piece of apparatus is shown in FIG. 7. A baseplace 21 has parts defining a hole 22 for ground placement of a golf ball. Mounted on the baseplate 21 are support members 22, 22*a* which carry a track 23 of adjustable height and inclination to the horizontal. A succession of golf balls 24 may be rolled down the track 23 and the placement of the baseplate 21 altered after the travel of each ball has been observed, until the desired direction of ball travel has been achieved. Members 22*a* may then be raised or lowered to alter the inclination of the track 23 until the latter is adapted to cause a ball, rolled down the track 23 from a fixed starting point, to reach the target area, such as a golf hole or practice saucer, in a reproducible manner. When this state of affairs has been achieved, the initial speed of the ball (upon leaving the track 23) is thereby fixed, and ground irregularities such as mounds, hollows and inclines, largely compensated for. A practice golf ball is thereupon placed in the hole 22, and the training device of FIGS. 1–5 or 6 is now placed alongsidethe baseplate 21 until a rod 3 thereof just touches a pair of spacer members 25 of the apparatus. At this point the whole extra apparatus 21, 22, 23 etc. shown in FIG. 7 is gently lifted and put aside leaving the practice golf ball on the ground or turf in a position previously determined by the hole 22. The putting stroke training device of the invention is now; likewise, in the correct position of use with respect to the target hole or practice saucer. All that remains to be determined by the player is the strength of his putting stroke, which must of course produce an initial ball speed equal or related to the initial speed of the final rolling ball previously mentioned.

It will be appreciated that different players adopt different stances involving various angles of the putter shaft to the horizontal. Similarly putters are provided with various angles between the shaft and head axes. The pivoting member 13 is provided, in the training device of the invention, to accommodate all these variations with a minimum of adjustment. It will also be appreciated that the player can switch from mechanically aided to unaided putting practice by the simple action of removing the putter clamp member 12 from the pivot member 13. The putter clamp member 12 is of small size and negligible weight, and presents no inconvenience to a player engaged in conventional putting practice.

It will also be realised that the two horizontal rods 3 of the embodiment described may be replaced by a planar member upon which the carriage 5 fits. Furthermore a single rod 3 may be used, when it is desired to permit pivoting instead of preventing it.

It is desirable that the sliding motion of the carriage along the guide member be as free from friction as possible, and to this end, any of a variety of known means may be employed. These include the use of highly polished surfaces, lubricating agents, magnetic and electromagnetic fields of repulsion, ball or roller bearings, or cushioning layers of air or other gases.

Figures 1, 2, 3:
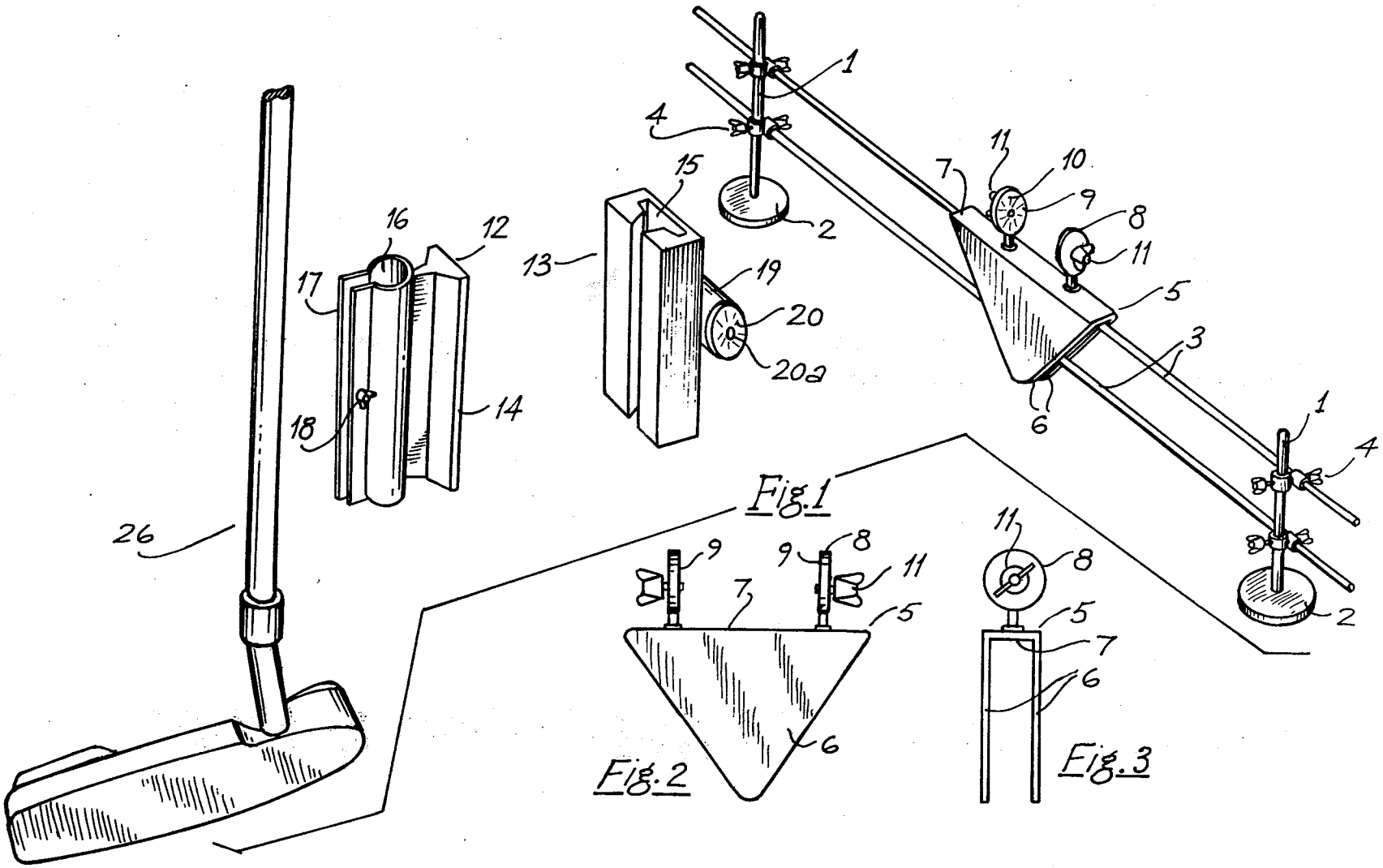
FIG. 2 is a front elevation of the carriage of FIG. 1.
FIG. 3 is a side elevation of the carriage of FIG. 2.
Figure 4:
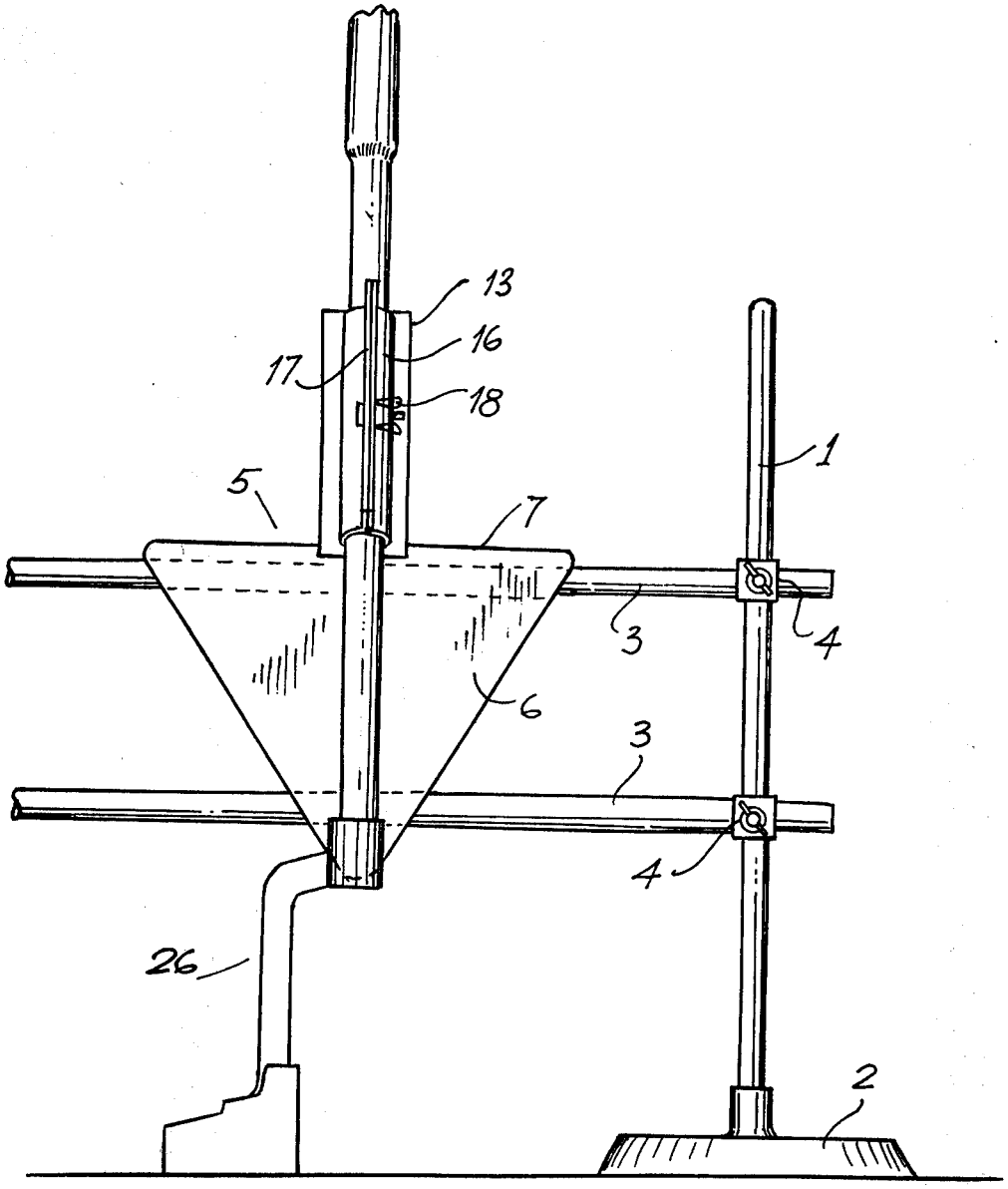
FIG. 4 is a front elevation of the assembled device and putter of FIG. 1, showing however only one of the support members for reasons of space.
Figure 5:
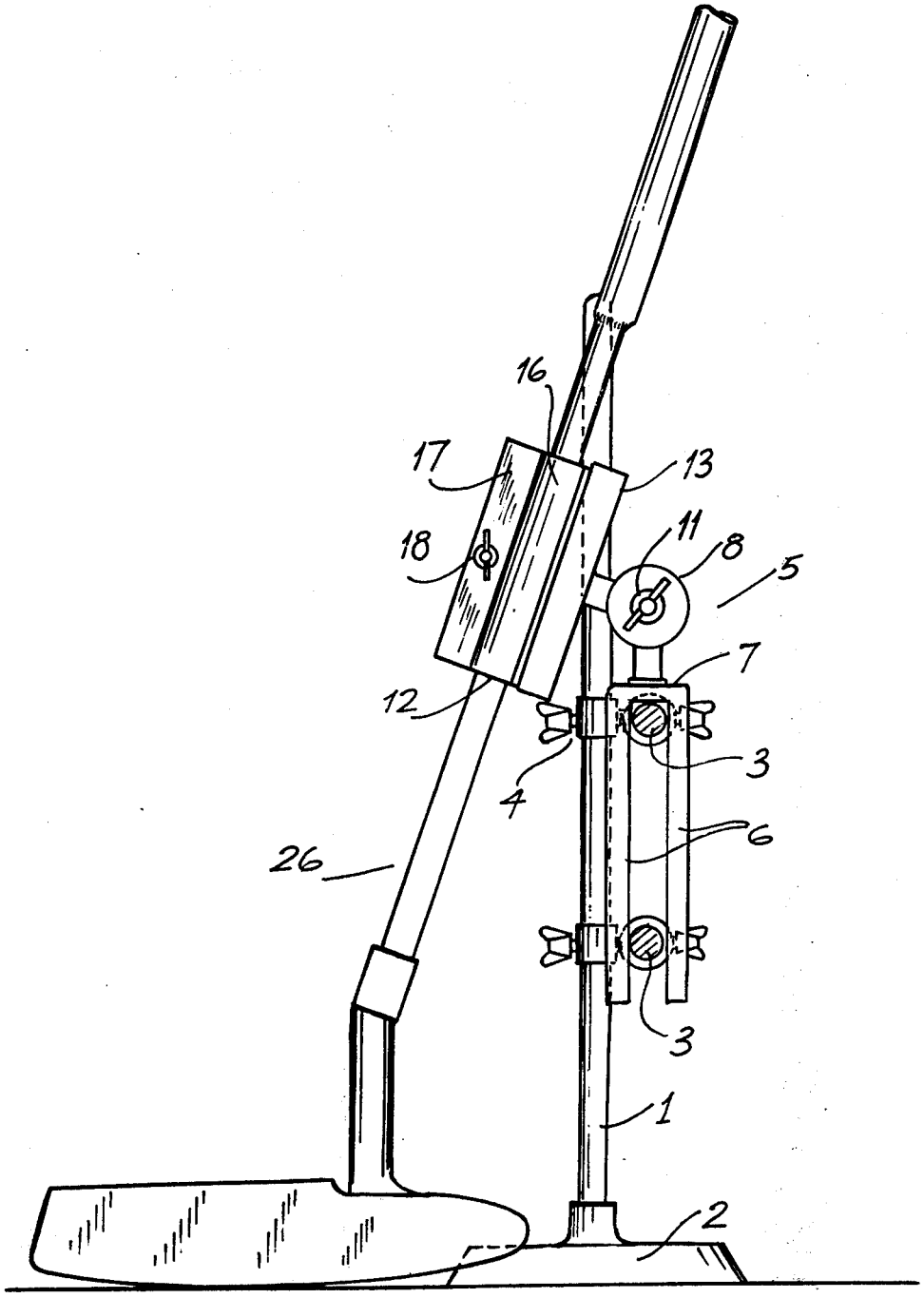
FIG. 5 is a side elevation of the device and putter of FIG. 4.

In the embodiment shown in FIG. 6, the rectilinear guide member 3 comprises two rods both attached to support members 1 by means other than the bosses 4 shown in FIGS. 1, 4 and 5, means moreover which occupy no extra space and which accordingly permit the carriage 5 to travel to either extremity of said guide member or even sweep right off the same into space. A combination of screw-threaded spigot ends and cooperating bores and threaded sockets is used, the support rod 1 being in two pieces 1*a* and 1*b*.

Still referring to FIG. 6, the guide member 3 projects horizontally in one direction (to the right) well beyond the support member 1. Thus the guide member 3 can overhang a golf green although both feet 2*a* may be outside the green standing on rough turf. This permits putting practice with the ball 6*a* placed on the green G (albeit the edge thereof) but all apparatus off the green, an arrangement likely to meet with the approval of those responsible for greens maintenance in golf clubs. The ready vertical adjustability of the feet 2*a* enables the user in placing the training device to compensate for slope and other surface irregularity of the ground.

What I claim is:

1. A device for use in striking a golf ball with a putter, and in training a player to develop a correct stroke, which device comprises:

(a) a ground-engaging support member;

(b) a guide member supportable by the support member and having, when so supported a horizontally disposed rectilinear upper edge;

(c) a guided carriage adapted to rest in contact with said upper edge, and free to move to-and-fro along said guide member when vertically lifted clear of said resting contact;

(d) means preventing movement of the guided carriage transversely of said upper edge, other than the vertical lift movement;

(e) means for rigidly attaching the shaft of a standard golf putter to the carriage with the putter head in ground contact; and (f) means associated with said means for attaching the shaft to the carriage for selecting the angle of elevation of said shaft to the horizontal so that the putter sole is flat upon the ground.

2. A training device as recited in claim 1 wherein the ground-engaging support member comprises at least two legs, adapted for parallel spaced-apart ground placement.

3. A training device as claimed in claim 1, further comprising a locating apparatus including a ground-engaging support, an inclined guide mounted thereon down which a golf ball can be rolled, and a spacer member adapted to abut against the guide member.

4. A training device as recited in claim 3, additionally comprising ground placement means for a golf ball cooperable with said locating apparatus.

5. A training device as recited in claim 1 wherein the angle-selecting means comprises cooperating lockable pivotal joint elements and forms a part of the guided carriage.

6. A training device as recited in claim 1 wherein the shaft-attaching means comprises a putter shaft clamp and a pivot member attachable in rigid manner one to the other, and wherein the guided carriage comprises a pivot housing adapted to receive and pivotally mount the pivot member in lockable manner.

7. A training device as recited in claim 1 wherein the movement-preventing means comprises two extensions of the guided carriage adapted to embrace the guide member and connected together at their upper extremities in use by a bridge member which can rest on said upper edge.

* * * * *